US005302016A

United States Patent [19]

Lautenschläger et al.

[11] Patent Number: 5,302,016

[45] Date of Patent: Apr. 12, 1994

[54] AUTOMATIC PULL-IN MECHANISM FOR DRAWER GUIDES

[75] Inventors: Gerhard Lautenschläger, Brensbach 1-Wersau; Horst Berger, Bielefeld, both of Fed. Rep. of Germany

[73] Assignee: Karl Lautenschläger GmbH & Co. KG, Reinheim, Fed. Rep. of Germany

[21] Appl. No.: 809,543

[22] PCT Filed: Apr. 15, 1991

[86] PCT No.: PCT/EP91/00710

§ 371 Date: Jan. 24, 1992

§ 102(e) Date: Jan. 24, 1992

[87] PCT Pub. No.: WO92/00027

PCT Pub. Date: Jan. 9, 1992

[30] Foreign Application Priority Data

Jun. 26, 1990 [DE] Fed. Rep. of Germany ..... 4020277

[51] Int. Cl.[5] ..... A47B 88/04

[52] U.S. Cl. ..... 312/333; 312/319.1; 292/71; 292/78; 292/DIG. 49

[58] Field of Search ..... 312/319.1, 333, 330.1; 16/80; 292/71, 78, DIG. 49

[56] References Cited

U.S. PATENT DOCUMENTS

| | | | |
|---|---|---|---|
| 3,506,292 | 4/1970 | Hagendourn et al. | 292/78 |
| 3,713,681 | 1/1973 | Worley | 292/78 |
| 5,015,048 | 5/1991 | Brunnert | 312/319.1 |
| 5,020,868 | 6/1991 | Brunnert | 312/319.1 |

FOREIGN PATENT DOCUMENTS

| | | | |
|---|---|---|---|
| 1262533 | 3/1968 | Fed. Rep. of Germany . | |
| 3716923 | 12/1988 | Fed. Rep. of Germany . | |
| 8903741 | 5/1989 | Fed. Rep. of Germany . | |
| 8907511 | 8/1989 | Fed. Rep. of Germany . | |
| 1117071 | 6/1968 | United Kingdom | 312/319.1 |

*Primary Examiner*—Brian K. Green

[57] ABSTRACT

An automatic pull-in mechanism for drawer guides consists of a guide rail and a runner rail, which are made longitudinally displaceable relative to one another by rolling bodies. On the guide rail there is disposed a component that can toggle between two end positions and is biased bistably toward the toggle end positions by a spring system, and has an open-ended slot for a projection projecting downward from the runner rail. The projection and the toggling component are so disposed relative to one another that upon a displacement of the runner rail from the drawer-open position to the drawer-closed position, as the projection approaches the latter it enters into the slot and then, after passing over the dead center of the toggling component, it is carried resiliently by the slot into the drawer-closed position.

12 Claims, 4 Drawing Sheets

Fig. 6
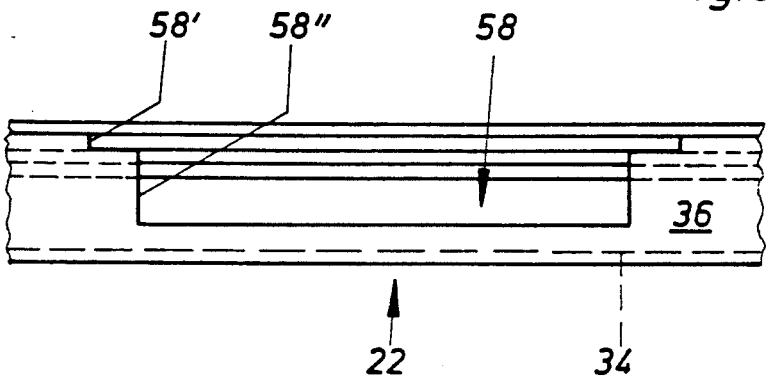
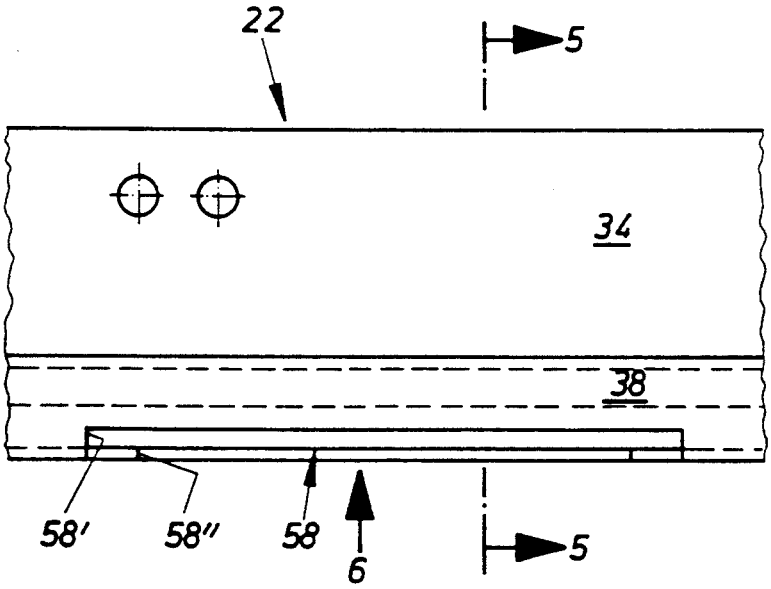
Fig. 4
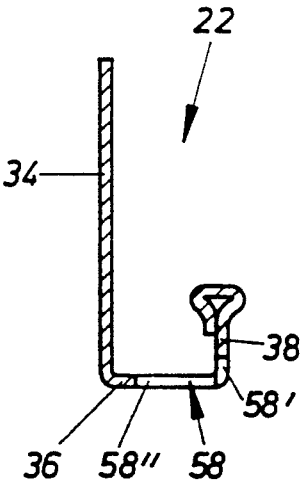
Fig. 5

162
148
59
162
152
160
156
180
174
172
9
8
154
164
152
170
160
174'
162
59
162
50
12
172
154
11
178
164
170
182
172
172
170
170
154
30
24
32
28
22
26
148

AUTOMATIC PULL-IN MECHANISM FOR DRAWER GUIDES

BACKGROUND OF THE INVENTION

The invention relates to an automatic pull-in mechanism for drawer guides; with a guide rail formed of sheet metal which is to be fastened to the carcase wall, which has a portion of its profile bent upwardly from a profile portion projecting at substantially right angles and horizontally from the carcase wall and entering from below into the corresponding runner rail formed by an open-bottomed hollow member which is to be fastened removably on the drawer, on which tracks are formed in the interior of the runner rail for rolling bearings mounted in an elongated cage, which can roll on the tracks of the guide rail on the one side and on tracks formed by associated portions of the inner surface of the runner rail, and thus permit a longitudinal displacement of the runner rail relative to the guide rail.

In addition to the roller drawer guides provided with rollers rotatably mounted on the guide rail and runner rail, such rolling bearing-mounted drawer guides have in recent times become widely used for the mounting of drawers in the corresponding cabinet, because the drawers are very easy to close and open even when bearing heavy weights. Precisely this easy running of such drawer guides, however, also has the disadvantage that a closed drawer can very easily be slightly opened accidentally, for example when an article of clothing on a person passing the cabinet catches on it. Also, when a drawer is shut forcefully and the drawer front collides with the carcase, a reaction occurs which again slightly opens the drawer. It has even been seen that, when a drawer is closed rapidly, it compresses the air trapped in the carcase interior and the displaced air then produces an opening thrust against the back of adjacent drawers, which, again on account of the easy running of the drawer guide, slightly opens the adjacent drawer. Therefore there is an urgent need to construct drawer guides such that as the drawer they are carrying approaches the closed position they will positively draw it into the fully closed position and hold it there with a closing force, even if slight, in order to prevent the effects described above. In the case of the roller drawer guides mentioned above, such a pulling-in action can be produced relatively simply by the weight of the drawer itself, by tilting slightly downwardly the portions of the guide rail or runner rail on which the rollers of the other rail run as they approach the closed position. When such a downwardly tilted portion of the rail is reached, a component of the weight force develops toward the carcase interior and pulls the drawer in. In drawer guides of the kind mentioned above, however, such a function cannot be realized, because the runner rail's support on the guide rail is provided by the roller bodies carried in cages and the runner rail completely surrounds the tracks of the guide rail. The ball races of the cooperating rails must therefore be made precisely rectilinear. The problem of the accidental opening of a closed drawer by catching or by the air-pumping effect of the closing of another drawer has been partially solved by providing catch means which act between the rails of the guides when the closed position is reached, because, for example, a resilient body, e.g., a wheel of elastomeric plastic, is mounted on one rail, preferably the guide rail, whose circumference, immediately before reaching the closed position, strikes against a projection or abutment provided fixedly on the other rail, i.e., the runner rail in this particular case. If an additional closing pressure is then exerted on the drawer toward the fully closed state, the resilient body, i.e., the resilient wheel, is first compressed radially until, in a dead center position, a maximum compression takes place. When this dead center is passed, the wheel resiliently returning to its original shape thrusts against the projection or abutment and, through the runner rail affixed to it, pushes the drawer into the closed position. Catch means of this kind or of similar or conceivable kinds, operating for example with ball catches or magnetic catches, have the disadvantage that they cannot become effective until just ahead of the closed position of the drawer, and then require an additional, greater exertion of pressure on the drawer in order to hold it in the closed position.

SUMMARY OF THE INVENTION

Accordingly, the invention is addressed to the problem of creating an automatic pull-in mechanism for drawer guides which, upon the closing of a drawer mounted on them, will become active decidedly before reaching the fully closed position, and at the same time can be so configured that the drawer, if desired, will be automatically carried to the fully closed position and closed automatically, without the exertion of an additional closing pressure.

Setting out from a drawer guide of the kind described above, this problem is solved in accordance with the invention by the fact that a component which can toggle between two end positions about a substantially vertical axis and biased bistably by a spring system to the toggle end positions is disposed on the guide rail, that in a section projecting into the carcase interior beyond the horizontal portion of the profile of the runner rail the toggling component has an open-ended slot for a projection reaching downward from the runner rail, and that the projection and the toggling component are so disposed relative to one another with respect to the runner rail and the guide rail that, upon a shift of the runner rail from the open-drawer position to the closed-drawer position, as the closed position is approached, enters into the slot of the toggling component that is in the end position associated with the drawer-open position, and then, after passing the dead center of the toggling component, is driven resiliently by the latter to the drawer-closed position. In the automatic pull-in mechanism thus configured it is possible to locate the pivoting end position associated with the drawer-open position such that it is virtually in or immediately ahead of the dead center position, so that therefore no additional closing pressure, or no noticeable one, is necessary in order to overcome the dead center. If on the other hand a certain pressure point is desired, it can also be achieved by the appropriate location of the pivoting end position of the toggling component that is associated with the open position.

The toggling component is preferably journaled in a separate, shallow, elongated case which is fastened on the horizontal portion of the profile of the guide rail, preferably so as to be removable.

Such a removable fastening can be accomplished, for example, by disposing the case on the bottom of the horizontal portion of the guide rail by means of studs projecting from the housing and inserted into bores in this guide rail portion, the studs then being affixed to the guide rail by upsetting or by forming them into resilient spreading fasteners. Alternatively and preferably the guide rail can also have, in the transition between its horizontal and right-angled portion of its profile entering into the runner rail an elongated, slot-like opening into which the can be fitted into the proper fastening position, the case having on the one hand abutments limiting their depth of insertion into the slot, and on the other hand at least two resilient tongues whose free ends, which are resiliently compressible when the case is inserted into the guide rail opening, spring open in back of the carcase-facing inside surface of the upwardly bent portion of the profile and secure the case against removal from the slot.

The projection cooperating with the slot in the toggling component can be provided either fixedly on the runner rail itself or, as an alternative and preferably, on a fitting holding the carcase-exterior front end of the runner rail on the drawer at the drawer-front end. This fitting and the projection can be made as an integral plastic component, just as the case holding the toggling component is also best made of plastic.

The magnitude of the pull-in movement, in the case of a toggling component journaled on an exclusively pivoting case, is dependent on the length of the lever arm between the pivoting axis of the toggling component and the slot. It is apparent that the length of the lever arm depends essentially on the dimensions of the drawer guides and can not be very great, i.e., although it is decidedly greater than in the known catch devices the effective pull-in distance is limited.

In increase in the pull-in length is achieved in an advantageous further development of the invention which is distinguished by the fact that a sliding guide cooperating with the toggling component is formed in the case, which positively guides the toggling component, in the end position associated with the open drawer, into the position in which the projection is aligned with the open end of the slot, and, when the projection enters the slot in the closing movement, after pivoting to the end position associated with the closed drawer, makes available an additional movement of the toggling component in the direction of the closing movement, and that a spring is provided which exercises a bias on the toggling component in the direction of the closed-drawer position.

At the same time the configuration is best made such that in the case at least one slide slot is incorporated which runs in a straight line in the direction of the drawer movement over the greater part of its length, but at its carcase-exterior end merges with an arcuate section carried to the associated carcase wall, and that on the toggling component two pins are formed projecting into the slide slot at a distance apart, whose position is selected such that one is in the arcuate front section of the slide slot when in the end position associated with the open drawer, while the second pin is in the front end portion of the rectilinear section of the slide slot.

The point of attachment of the spring to the toggling component is then selected such that the line of application of the spring tension when the toggling component is in the opening position passes between the two pins.

This spring is preferably an elongated coil spring attached to the toggling component at one end and the case on the other, and its length is such that, in the drawer-closed position it exercises a residual bias force against the toggling component.

Preferably the coil spring is disposed in an elongated recess in the housing running substantially parallel to the rectilinear section of the slide slot.

Alternatively, an elongated, flexible pulling means, preferably in the form of a cord or chain, can be attached to the toggling component and biased by a separate tensioning means.

This tensioning means can have, for example, a tensioning wheel winding the pulling means on its circumference and biased in a winding position by a spiral spring. Especially when the automatic pull-in mechanism is to become active very early on, i.e., when the drawer is pushed only partially into the cabinet carcase, the latter configuration is recommended, because considerable lengths of the pulling means can be wound onto the tensioning wheel of this kind of biasing means.

The automatic pull-in mechanism according to the invention can become active only if, when the associated drawer is closed, the toggling component is actually in its end position associated with the open drawer. It is not impossible, however, that, due for example to a lack of caution in the installation of the guide rail, the toggling component may be in the end position associated with the closed drawer. It is then obvious that the automatic pull-in mechanism will not operate, and it is even conceivable that the drawer then cannot be pushed all the way closed because the projection associated with the runner rail then collides with the body of the toggling component ahead of the slot. To restore the function of the automatic pull-in mechanism in this case without difficult manual operations it is desirable to provide immediately ahead, in the drawer-closing direction, of the slot of the toggling component a catch which is retracted into the case in the toggle end position associated with the drawer-open position into the path of the projection protruding from the runner rail, and, in the toggle end position associated with the drawer-closed position, protrudes into the path of the projection but can be overridden in the drawer-closing direction by resilient deformation.

In the case of the automatic pull-in mechanism thus configured, if the toggling component is already in the end position associated with the closed drawer, before the projection associated with the runner rail has entered into the slot in the toggling component, this projection at least passes over the resilient catch, which then snaps back and, if the drawer is pulled back a short distance, drives the toggling component into the end position associated with the open drawer. That is to say, the automatic pull-in mechanism is then made operative again by this short pulling back of the drawer.

BRIEF DESCRIPTION OF THE DRAWINGS

The invention will be further explained in the following description of a number of embodiments, in conjunction with the drawing, wherein:

FIG. 4 shows a portion of the guide rail of the drawer guide shown in FIG. 1, in the area of the cut-out for the part of the automatic pull-in mechanism that is to be attached on the guide rail side, as seen in the direction of arrow 4 in FIG. 1;

FIG. 5 is a cross section seen in the direction of the arrows 5—5 in FIG. 4, and FIG. 6 a view of the section of the guide rail seen in the direction of arrow 6 in FIG. 4;

DESCRIPTION OF THE PREFERRED EMBODIMENTS

Figure 1:
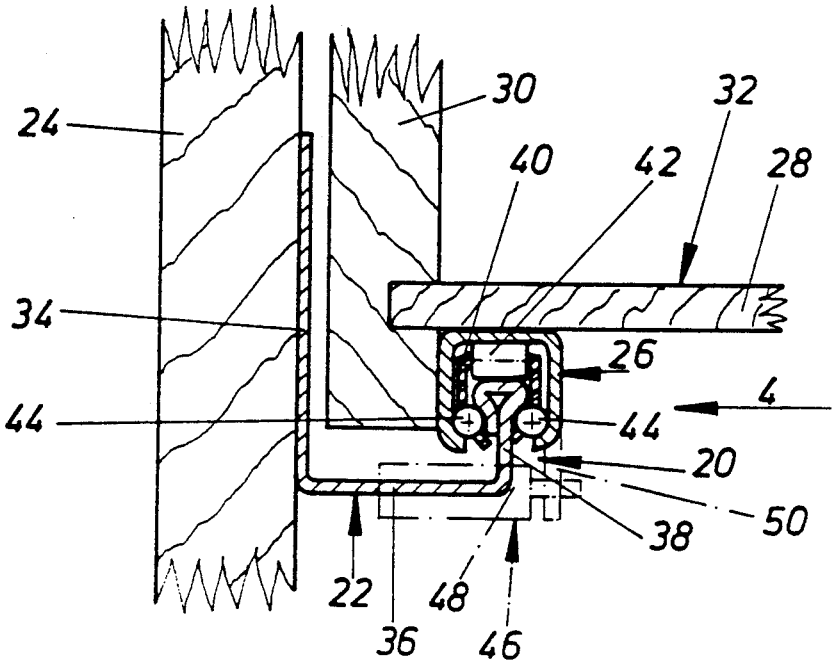
FIG. 1 is a cross section taken in a plane running transversely of the direction of drawer movement through a drawer guide of the kind here in question, additionally showing a section of the carcase wall supporting the guide rail and of the drawer mounted on the runner rail, also in cross section.

FIG. 1 shows a cross section taken at right angles to the direction of drawer movement, through a drawer guide identified as a whole by 20, which shows the arrangement of the guide rail 22 on the corresponding carcase wall 24 and the arrangement of the runner rail 26 under the drawer bottom 28 and alongside the inner surface of the side 30 of the drawer 32 that reaches downwardly below the bottom. The guide rail 22 is bent in the usual manner from sheet metal and has a vertical portion 34 provided for fastening to the supporting wall 24, a horizontal portion 36 bent at right angles from the latter and reaching under the drawer, and a portion 38 bent upwardly at right angles from the latter and entering from below in the corresponding runner rail 26, having on its end lying within the runner rail races for rolling bodies held in a plastic cage 40, namely a series of rollers 42 and two laterally spaced rows of balls 44 in this particular case. With the rolling bodies are associated appropriate races in the interior of the open-bottomed track 26 which is likewise bent from sheet metal.

Figure 13:
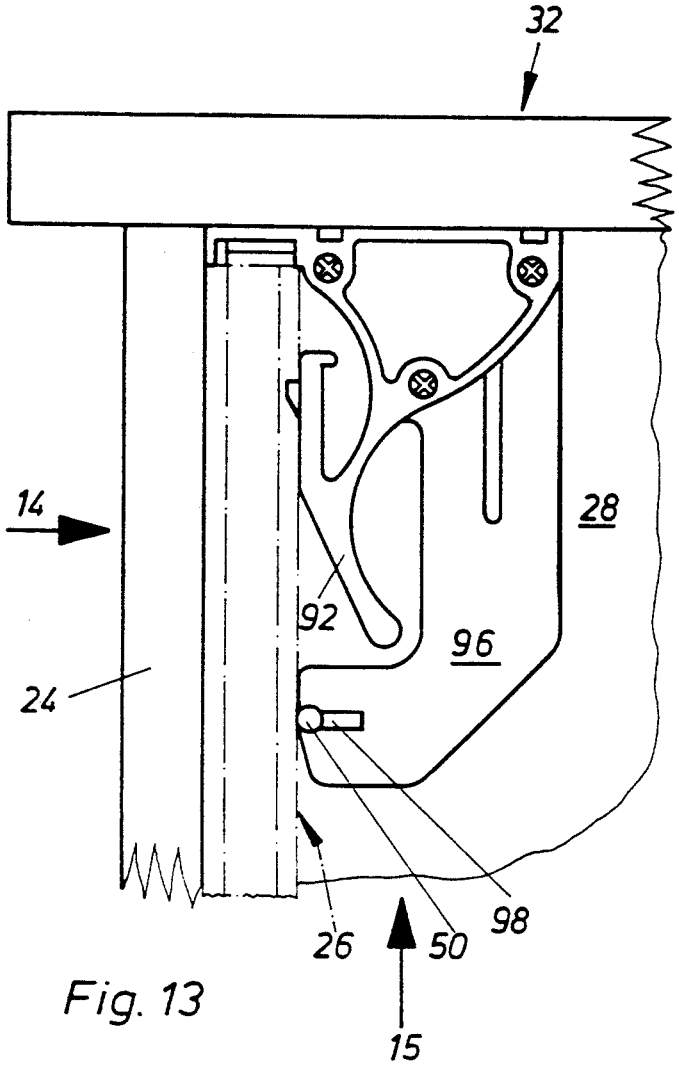
FIG. 13 is a bottom view of a front corner area of a drawer with a fastening piece releasably holding the drawer-front end of the runner rail, on which the projection cooperating with the part of the third embodiment associated with the guide rail is integrally provided.
Figure 15:
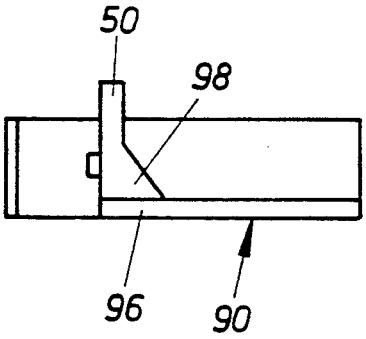
FIG. 15 is a view of the fastening piece for the front end of the runner rail, seen in the direction of arrow 15 in FIG. 13.

The automatic pull-in mechanism 46 which, when the drawer 32 approaches the closed position, pulls the drawer into the fully closed position and holds it there is indicated in broken lines in FIG. 1, and it can be seen that this mechanism has a portion 48 disposed underneath the runner rail 26 in the area of the transition from portion 38 to portion 36, and a pin-like projection 50 extending downwardly from the runner rail, which can be either fastened directly to the runner rail 26 or can be part of a fitting holding the runner rail on the drawer, as will be further explained below in connection with FIGS. 13 and 15.

Figure 2:
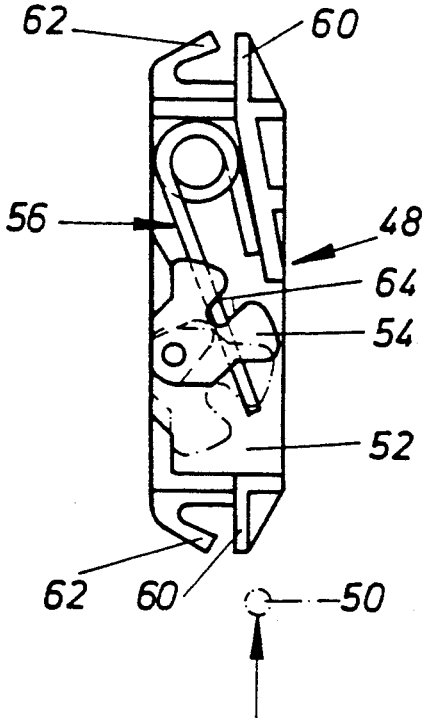
FIG. 2 is a plan view of a first embodiment of the portion of an automatic pull-in mechanism according to the invention.

In FIG. 2 is a plan view of a first embodiment of the part 48 of automatic pull-in mechanism 46 that is associated with the guide rail and is shown only in broken lines in FIG. 1; this part 48 is composed of essentially three components, namely a shallow, elongated case 52 injection molded from plastic and open on the top, a flat component 54 which is mounted so as to toggle between two end positions about a substantially vertical axis, and a spring, which in this particular case is a two-legged spring 56 whose one leg is engaged by the toggling component 54 so as to urge it bistably to either of two possible end positions and hold it therein. The toggling component 54 can be switched by an external force against the applied spring force from the one position, e.g., the one shown in FIG. 2, which is associated with the closed-drawer position, to the other end position, represented in broken lines in the drawing and associated with the open-drawer position, the configuration being made such that the closing moment produced by the bias of the spring at first becomes increasingly weaker until it vanishes at a dead-center position, in order then to become increasingly stronger as turning continues, but in the opposite direction. In the embodiments here under discussion the geometrical association of the axis of rotation of the toggling component to the thrusting surface of the spring and its position is made such that the above-mentioned dead-center position is reached immediately before reaching the end position associated with the open-drawer position, so that therefore the thrust holding the toggling component in this end position associated with the open-drawer position is very weak and, when a drawer is pushed inwardly, no appreciable force has to be exerted to overcome this opening thrust.

As mentioned above, the case 52 is made relatively shallow and elongated, so that in the position diagrammatically represented in FIG. 1 it can be introduced into a slot-like recess 58 in the rail 22 as will be described below in connection with FIGS. 4 to 6, and can be held therein in the proper operating position. The case 52 and the recess 58 are therefore made to mate with one another such that the case 52 can be inserted until it is in contact with the edges of portions 38 laterally defining the recess 58, rib-like abutments 60 being provided for this purpose on the opposite sides of the case. On the section of case 52 situated within the guide rail and above portion 36 of the guide rail resilient tongues 62 are formed at both ends, which are squeezed resiliently together when the case 52 is inserted into the recess, but when in the properly installed position they spring open behind the carcase-related inside surface of rail portion 36 and then secure the case against removal from the recess. The location of the pivot axis of the toggling component 54 and its external shape are to be seen in the drawing, and it can be seen that the pivot axis is set within the case as closely as possible to the carcase wall 24, and that the toggling component 54 has in its opposite free end area an open-ended slot 64 into which the previously mentioned pin-like projection 50 can enter and drive the toggling component with it. The pin-like projection 50 is represented in broken lines in FIG. 2 under part 48, the arrow pointing toward it indicating the direction in which it moves upon the closing of the drawer. The toggling component is then still in the end position associated with the drawer-open position indicated in broken lines. It can be seen that the pin-like projection 50, as it advances in the direction of the arrow, enters into the slot 64 and pushes the toggling component counterclockwise. After the dead center is passed, the above-mentioned thrust acting in the closing direction then develops in the toggling component 54 and is transferred to the pin-like projection. Since this projection is rigidly joined to the runner rail 26, which in turn is holding the drawer 32, the drawer is thus positively pulled to the fully closed position.

Figure 3:
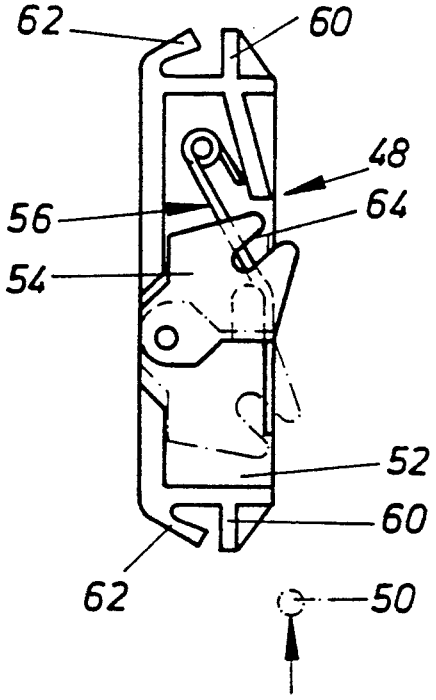
FIG. 3 is a plan view of an alternative embodiment of the portion of an automatic pull-in mechanism that is to be attached to the guide rail.

FIG. 3 shows a modified embodiment of the part 48 shown in FIG. 2 and described above, which basically is not functionally different from the embodiment in FIG. 2 which has already been described. To avoid unnecessary repetition it is therefore sufficient, in regard to the embodiment in FIG. 3, to refer to the explanations of part 48 given in connection with FIG. 2, inasmuch as functionally equal parts of both embodiments are associated in the drawing with the same reference numbers.

FIGS. 4 to 6 show the section of guide rail 22 in which the slot-like recess 58 is provided for accommodating part 48 (according to FIG. 2 or FIG. 3, or also of the part 148 that is yet to be described below in connection with FIGS. 7 to 12). It can be seen that slot portion 58' in the recess 58 formed in rail portion 38 is slightly wider than portion 58" continuing in rail portion 36, so that rail portion 36 forms strip-like portions with which grooves 59 of matching cross section running horizontally in the narrow end faces of case 52 of part 48 can be associated, as they are also represented below in the embodiment to be described in connection with FIGS. 7 to 12. Such grooves, however, are also best provided in the embodiments in FIGS. 2 and 3, although they cannot be seen in the views of these embodiments represented in these figures.

Figures 7, 8, 9, 10, 11, 12:
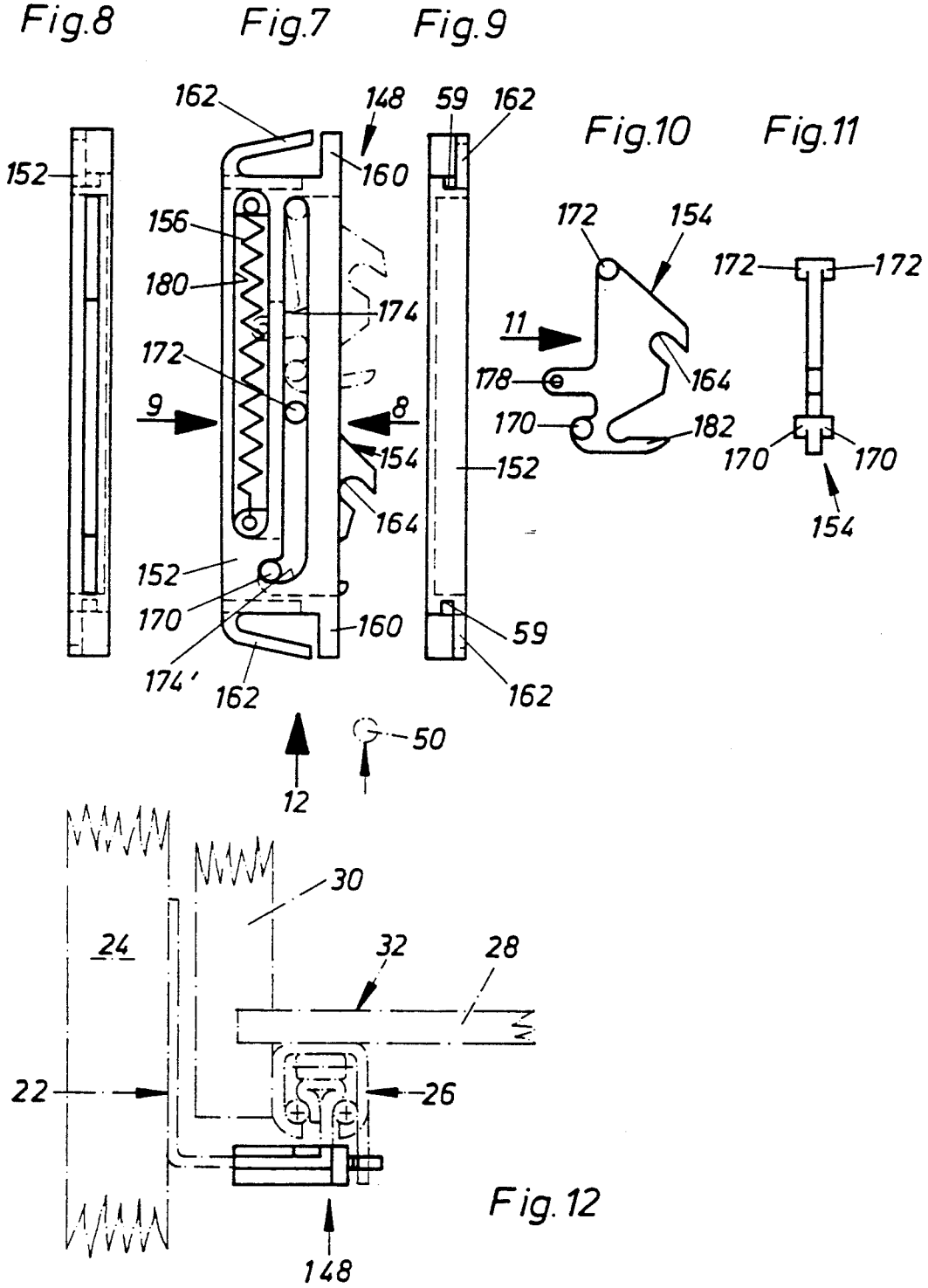
FIG. 7 is a plan view of the part of a third embodiment of the automatic pull-in mechanism according to the invention that is associated with the guide rail.
FIG. 8 is a view of the case of the part associated with the guide rail, seen in the direction of arrow 8 in FIG. 7.
FIG. 9 is a view of the case, seen in the direction of arrow 9 in FIG. 7.
FIG. 10 is a plan view of the toggling component disposed in the housing of FIGS. 7 to 9.
FIG. 11 is a view of the toggling component, seen in the direction of the arrow 11 in FIG. 10.
FIG. 12 is a view of the part associated with the guide rail, seen in the direction of arrow 12 in FIG. 7, wherein the corresponding guide rail and runner rail, and the adjoining part of the carcase wall and of the drawer are represented as in FIG. 1, but in broken lines.

FIGS. 7 to 12 relate to the above-mentioned third embodiment, FIGS. 7 and 12 showing the complete guide-rail-related part 148, FIGS. 8 and 9 the case 152, and FIGS. 10 and 11 the toggling component 154. In this third embodiment of the automatic pull-in mechanism, the part associated with the guide rail is marked 148, which will be described hereinafter only to the extent that it differs from the embodiments in FIGS. 2 and 3. In regard to the parts that are the same, however, it will suffice to refer to the description on these figures, inasmuch as functionally comparable parts of all embodiments are given the same reference numbers in the drawing, but in the case of the third embodiment now to be described, the numbers are preceded by a "1".

The toggling component 154 is journaled in the case 152 and in such a manner, in this case, that an initial toggling movement of the toggling component 154 produced by the drawer 32 or by the projection 50 moved by the drawer is followed by a rectilinear pulling-in movement in the drawer closing direction, thereby substantially increasing the effective pulling-in distance in comparison with the embodiments previously described. To bring this about, the toggling component 154 is not journaled on a fixed axis on the case 152 but in a sliding guide which is formed by two pins 170 and 172 projecting from both sides of toggling component 154 at a distance apart, and two slide slots 174, one in each of the case walls holding the toggling component 154 between them. The slide slots 174 are rectilinear over most of their length, but at the front end they pass into an arcuate section 174' which the pin 172 enters when the drawer is opened and then is deflected by the arcuate shape of section 174', resulting in the toggle action of the toggling component 154 permitting the projection 50 associated with the runner rail to exit from slot 164. The toggling component 154 is biased by an elongated coil spring 156 to the end position associated with the drawer-closed position, the one end of coil spring 156 being held in an opening 178 in toggling component 154 and the other end in the carcase-interior end portion of a recess 180 provided in case 152 and running parallel to the rectilinear section of the slide slot 174, and accommodating the coil spring. The point of attachment of the coil spring 156 to the toggling component 154 is so chosen that the line of action of the spring tension exerted by it on toggling component 154 passes between the two pins 170 and 172 when the toggling component 154 is in the opening position, causing the lever to be held in the opening position until the incipient toggling movement, when the projection 50 enters into the slot 164, causes the pin 170 to come out of the arcuate section 174' of the slide slot 174 and pass into the rectilinear section. Then the spring can withdraw the toggling component completely into the interior of the case, so that then the drawer is pulled into the fully closed position and held therein.

It is apparent that, in this embodiment, the length of the pull-in distance depends almost exclusively on the length of the rectilinear portion of the slot 174. Lengthening the slot naturally also results in a lengthening of the case 152, and then the corresponding recess 58 in the guide rail 22 would also have to be lengthened accordingly. To prevent weakening the guide rail 22 by an excessively long recess 58, it may then be necessary to fasten the case 152 to the bottom of portion 36 of the guide rail. The guide rail recess 58 is then eliminated and there is no need to fear weakening the guide rail.

In creating long pull-in distances in the manner indicated above, it can happen that coil springs having a sufficiently long stretching length with a sufficiently great remainder of biasing force in the closed position are no longer available. The bias exerted on the toggling component can then be exerted via an elongated, flexible pulling means engaging the toggling component, such as a wire or a chain which is engaged by a tensioning means that makes available a sufficiently long stretching length. This tensioning means can be constituted, for example, by a journaled tensioning wheel on whose circumferential surface the pulling means can be wound, and which is biased in the winding direction by a spiral spring.

On the toggling component a resilient catch 182 is provided ahead (as seen in the drawer closing direction) of the slot 164; as it can be seen in FIG. 7, the catch is withdrawn into the case when the toggling component 154 is in its end position associated with the drawer-open position, but when the toggling component is in the rearward end position, represented in broken lines in FIG. 7, it protrudes from the case. When the toggling component 154 is in the end position inside the carcase during the installation of the drawer, or due to manipulation while the drawer is removed, without having been actuated by the projection 50 associated with the runner rail, the automatic pull-in mechanism not only would be inactive, but also the drawer could not be closed all the way, because the projection 50 would collide with the toggling component at a point ahead of the slot 164 before the drawer is fully closed. The catch 182, however, makes it possible in this case to catch the projection 50 and then, upon a single pulling back of the drawer, swing the toggling component 154 back to its front-end position, making the automatic pull-in mechanism fully operative.

Figure 14:
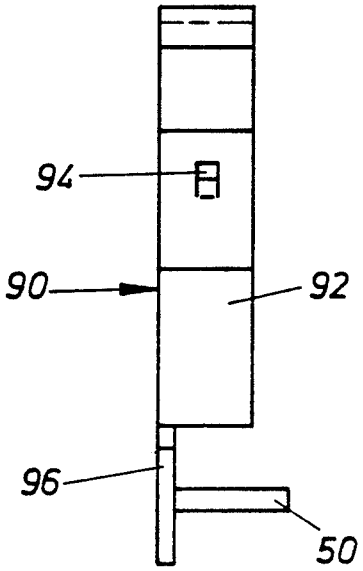
FIG. 14 is a view of the fastening piece for the front end of the runner rail, seen in the direction of arrow 14 in FIG. 13.

In FIGS. 13 to 15 there is shown a fastening piece 90 for the front end of the runner rail 26, which as such as known in itself, and therefore is not further described. As to the operation of this piece 90 it will only be mentioned that on one arm of a mounting arm 92 configured as a double-arm lever a projection 94 is provided which can catch in a corresponding opening in the confronting lateral face of the runner rail 26. The runner rail can be released by pressing on the other arm of the mounting arm 92.

What is novel, however, and important in connection with the present invention, is the arrangement of the projection 50 on this fastening piece 90, and its base plate 96 is formed accordingly. In an area of this base plate directly adjacent the runner rail 26, the projection 50 is then provided and, if the fastening piece 90 is injection-molded from plastic, the projection 50 can even be made integral with the base plate. At the same time it is then possible to stabilize the projection 50 against lateral flexural stress by one reinforcing rib 98, or more reinforcing ribs not shown.

We claim:

1. An automatic pull-in mechanism in combination with a drawer guide, (a) the drawer guide having a guide rail formed of sheet metal which is to be fastened to a carcase wall of a carcase, the guide rail having a portion of its profile bent upwardly from a profile portion, the profile portion projecting at substantially a right angle and horizontally from the carcase wall, the upwardly bent portion of the guide rail entering from below into a corresponding runner rail formed by an open-bottomed hollow member which is to be fastened removably on a drawer, the runner rail having tracks formed in an interior thereof for roller bearings mounted in an elongated cage, the roller bearings being rollable via an inside portion thereof on an outside portion of the upwardly bent portion of the guide rail and the roller bearings being rollable via an outside portion thereof on the tracks formed by associated portions of an inner surface of the runner rail to thereby permit a longitudinal displacement of the runner rail relative to the guide rail, the runner rail having a projection reaching downward therefrom into an interior of the carcase, (b) the automatic pull-in mechanism comprising a shallow, elongated case for fastening to the profile portion of the guide rail, the pull-in mechanism having journaled therein a toggling component which can move between two end positions and which toggling component is biased by a spring, the toggling component having an open-ended slot such that when the pull-in mechanism is disposed on the guide rail with the toggling component disposed in a location extending past the profile portion of the guide rail and into the carcase interior, the open-ended slot can receive the projection, the case further comprising at least one slide slot which comprises a straight section running rectilinearly over a greater part of a length of the case and an arcuate end section curved toward an associated carcase wall, the straight section of the slide slot merging at its carcase-exterior end with the arcuate end section, and wherein the toggling component has at a distance from one another two protruding pins which protrude into the slide slot, the two pins being located such that when the toggling component is in an end position associated with an open-drawer position, one pin is in the arcuate end section of the slide slot, while the second pin is in a front end part of a section of the slide slot adjacent the arcuate section, whereby when the toggling component is disposed relative to the runner rail and the guide rail such that, upon a shift of the runner rail from the open-drawer position to a closed-drawer position, as the closed-drawer position is approached, the toggling component is in the end position associated with the open-drawer position and receives the projection into the open-ended slot, and such that after the toggling component is driven by the projection to the open-drawer position of the toggling component, the projection and an associated runner rail is thereby driven resiliently by the toggling component to the closed-drawer position by the biasing force of the spring.

2. The combination according to claim 1, wherein the case is fastened releasably to the guide rail.

3. The combination according to claim 2, wherein the guide rail has, in an area of transition between the profile portion and the upwardly bent portion, a slot-like, elongated recess into which the case can be introduced fittingly into a correct fastening position, and wherein the case further comprises abutments limiting the depth of insertion into the recess and at least two resilient tongues, free ends of which are resiliently compressible upon the insertion of the case into the guide rail recess, such that the tongues spring open behind a carcase-facing inside surface of the upwardly bent portion to secure the case against withdrawal from the recess.

4. The combination according to claim 1, wherein the projection is rigidly fastened to the runner rail.

5. The combination according to claim 1, wherein the projection is rigidly provided on a fastening piece mounting a carcase-exterior front end of the runner rail on the drawer at a drawer-front end.

6. The combination according to claim 5, wherein the fastening piece and the projection are configured as a integral plastic component.

7. The combination according to claim 1, wherein a point of engagement of the spring with the toggling component is such that when the toggling component is in the open-drawer position, a line of direction of tension of the spring passes between the two pins.

8. The combination according to claim 1, wherein the spring is an elongated coil spring engaging the toggling component at one end of the spring and the case at the other end of the spring, and a length of the spring is such that the spring exerts a residual bias force on the toggling component in the drawer-closed position.

9. The combination according to claim 8, wherein the coil spring is disposed in an elongated recess of the case, the coil spring running substantially parallel to the straight section of the slide slot.

10. The combination according to claim 1, wherein the toggling component further comprises a resilient catch located at a distance from the open-ended slot and towards the interior of the carcase, such that when the toggling component is in the end position associated with the open-drawer position the catch is retracted into the case so as to be outside of the path of the projection and such that when the toggling component is in the end position associated with the closed-drawer position, the catch protrudes into the path of the projection to thereby retain the projection such that the retaining action can be overriden in the drawer-closing direction by resilient deformation of the catch.

11. An automatic pull-in mechanism in combination with a drawer guide, (a) the drawer guide having a guide rail formed of sheet metal which is to be fastened to a carcase wall of a carcase, the guide rail having a portion of its profile bent upwardly from a profile portion, the profile portion projecting at substantially a right angle and horizontally from the carcase wall, the upwardly bent portion of the guide rail entering from below into a corresponding runner rail formed by an open-bottomed hollow member which is to be fastened removably on a drawer, the runner rail having tracks formed in an interior thereof for roller bearings mounted in an elongated cage, the roller bearings being rollable via an inside portion thereof on an outside portion of the upwardly bent portion of the guide rail and the roller bearings being rollable via an outside portion thereof on the tracks formed by associated portions of an inner surface of the runner rail to thereby permit a longitudinal displacement of the runner rail relative to the guide rail, the runner rail having a projection reaching downward therefrom into an interior of the carcase, (b) the automatic pull-in mechanism comprising a shallow, elongated case for fastening to the profile portion of the guide rail, the pull-in mechanism having journaled therein a toggling component which can move between two end positions and which toggling component is biased by a spring, the toggling component having an open-ended slot such that when the pull-in mechanism is disposed on the guide rail with the toggling component disposed in a location extending past the profile portion of the guide rail and into the carcase interior, the open-ended slot can receive the projection, the case further comprising a slide guiding means cooperating with the toggling component to positively and slidingly guide the toggling component from an end position of the toggling component associated with an open-drawer position to a position aligned with the projection such that the projection is received in the open-ended slot of the toggling component during a movement of the runner rail toward a closed-drawer position, the slide guiding means being formed such that the toggling component, in cooperation with the projection received in the open-ended slot of the toggling component, can be further displaced in the direction of the closing movement of the projection and associated runner rail, the spring exerting a bias on the toggling component in a direction of the closed-drawer position, whereby when the toggling component is disposed relative to the runner rail and the guide rail such that, upon a shift of the runner rail from the open-drawer position to the closed-drawer position, as the closed-drawer is approached, the toggling component is in the end position associated with the open-drawer position and receives the projection into the open-ended slot, and such that after the toggling component is driven by the projection to the open-drawer position of the toggling component, the projection and an associated runner rail is thereby driven resiliently by the toggling component to the closed-drawer position by the biasing force of the spring, wherein the toggling component further comprises a resilient catch located at a distance from the open-ended slot and towards the interior of the carcase, such the when the toggling component is in an end position associated with the drawer-open position, the catch is retracted into the case so as to be outside of a path of the projection, and such that when the toggling component is in an end position associated with the closed-drawer position, the catch protrudes into the path of the projection to thereby retain the projection such that the retaining action can be overridden in the drawer-closing direction by resilient deformation of the catch.

12. An automatic pull-in mechanism in combination with a drawer guide, (a) the drawer guide having a guide rail formed of sheet metal which is to be fastened to a carcase wall of a carcase, the guide rail having a portion of its profile bent upwardly from a profile portion, the profile portion projecting at substantially a right angle and horizontally from the carcase wall, the upwardly bent portion of the guide rail entering from below into a corresponding runner rail formed by an open-bottomed hollow member which is to be fastened removably on a drawer, the runner rail having tracks formed in an interior thereof for roller bearings mounted in an elongated cage, the roller bearings being rollable via an inside portion thereof on an outside portion of the upwardly bent portion of the guide rail and the roller bearings being rollable via an outside portion thereof on the tracks formed by associated portions of an inner surface of the runner rail to thereby permit a longitudinal displacement of the runner rail relative to the guide rail, the runner rail having a projection reaching downward therefrom into an interior of the carcase, (b) the automatic pull-in mechanism comprising a shallow, elongated case for fastening to the profile portion of the guide rail, the pull-in mechanism having journaled therein a toggling component which can move between two end positions and which toggling component is biased by a spring, the toggling component having an open-ended slot such that when the pull-in mechanism is disposed on the guide rail with the toggling component disposed in a location extending past the profile portion of the guide rail and into the carcase interior, the open-ended slot can receive the projection, the case further comprising a slide guiding means cooperating with the toggling component to positively and slidingly guide the toggling component from an end position of the toggling component associated with an open-drawer position to a position aligned with the projection such that the projection is received in the open-ended slot of the toggling component during a movement of the runner rail toward a closed-drawer position, the slide guiding means being formed such that the toggling component, in cooperation with the projection received in the open-ended slot of the toggling component, can be further displaced in the direction of a closing movement of the projection and associated runner rail, the spring exerting a bias on the toggling component in a direction of the closed-drawer position.

whereby when the toggling component is disposed relative to the runner rail and the guide rail such that, upon a shift of the runner rail from the open-drawer position to the closed-drawer position, as the closed-drawer position is approached, the toggling component is in the end position associated with the open-drawer position and receives the projection into the open-ended slot, and such that after the toggling component is driven by the projection to the open-drawer position of the toggling component, the projection and an associated runner rail is thereby driven resiliently by the toggling component to the closed-drawer position by the biasing force of the spring, wherein the guide rail has, in an area of transition between the profile portion and the upwardly bent portion, a slot-like, elongated recess into which the case can be introduced fittingly into a correct fastening position, and wherein the case further comprises abutments limiting a depth of insertion into the recess and at least two resilient tongues, free ends of which are resiliently compressible upon the insertion of the case into the guide rail recess, such that the tongues spring open behind a carcase-facing inside surface of the upwardly bent portion to secure the case against withdrawal from the recess.

* * * * *